United States Patent [19]

Isshiki

[11] Patent Number: 4,764,173

[45] Date of Patent: Aug. 16, 1988

[54] PROCESS FOR RESUSCITATING ANIMAL FIBERS

[75] Inventor: Tadao Isshiki, Tokyo, Japan

[73] Assignee: Rakkasan Company Ltd., Tokyo, Japan

[21] Appl. No.: 680,445

[22] Filed: Dec. 11, 1984

[30] Foreign Application Priority Data

Dec. 12, 1983 [JP] Japan ..... 58-234649
Feb. 1, 1984 [JP] Japan ..... 59-17869

[51] Int. Cl.[4] ..... D06M 1/20
[52] U.S. Cl. ..... 8/115.52; 204/135
[58] Field of Search ..... 204/135; 8/115.52, 115.53

[56] References Cited

U.S. PATENT DOCUMENTS 2,523,486 9/1950 Whitmore ..... 204/135
3,817,701 6/1974 Thorsen ..... 8/115.52
4,246,131 1/1981 Lohr ..... 252/DIG. 13

*Primary Examiner*—A. Lionel Clingman
*Assistant Examiner*—John F. McNally
*Attorney, Agent, or Firm*—Sughrue, Mion, Zinn, Macpeak, and Seas

[57] ABSTRACT

Disclosed is a process for resuscitating animal fibers which comprises charging animal fibers such as feather and wool with negative ions. The present invention not only permits the animal fibers to keep or revive fluffy and soft touch inherent therein, prevents harmful insects from parasitism, but removes foul odor peculiar to protein.

12 Claims, 1 Drawing Sheet

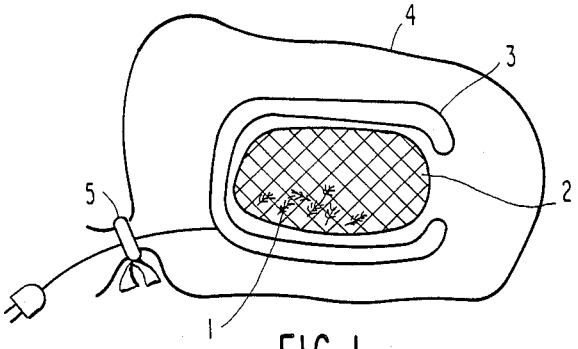
FIG. 1
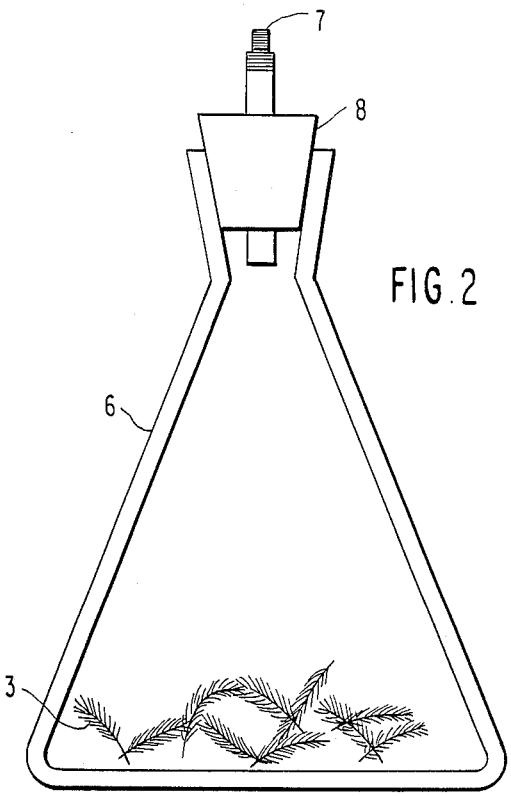
FIG. 2
FIG. 3
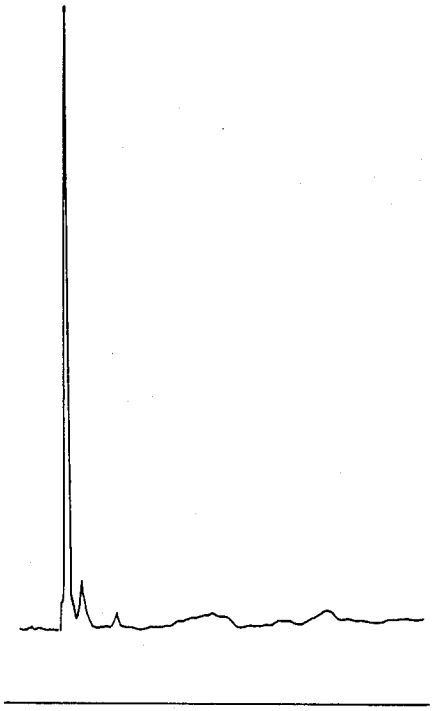
FIG. 4
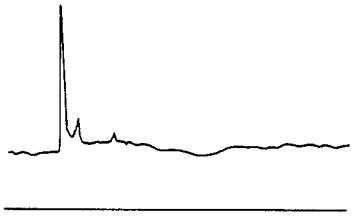

PROCESS FOR RESUSCITATING ANIMAL FIBERS

BACKGROUND OF THE INVENTION

1. Field of the Invention

The present invention generaly relates to a resuscitation process of animal fibers, more particularly, to a process for resuscitating natural crimps inherent in the animal fibers, retaining and recovering fluffy and soft touch, removing foul odor peculiar to the animal fibers, and preventing parasitism of insects and growth of mold.

2. Description of the Prior Art

Animal fibers such as feather, wool and mohair have long been for use in bedding, clothings, carpets and the like. Above all, feather and wool have excellent heat retaining property, lightweight, soft touch and the like and therefore have been in widespread use for high-grade bedding in recent years. Wool has natural crimps having superior heat retaining property and soft touch, but is normally subjected to a crimp processing then supplied for practical use. Although the crimp processing is attained by physical or chemical treatment, it involves a fatal drawback of injuring fibers per se and thus damaging durability.

Moreover, the animal fibers contain protains such as keratin as a major ingredient so that they emit foul odor inherent in proteins when ventilation is poor. For deodorization and degreasing, surface active agents are used in greater amounts but those not only damage fibers, but require a great quantily of water for washing to thus raise problems in equipment and cost. Still worse, waste water after washing leads to environmental pollution.

SUMMARY OF THE INVENTION

It is therefore an object of the present invention to provide a process for resuscitating natural crimps inherent in animal fibers whereby fluffy volume and soft feeling are retained and restored.

It is another object of the present invention is to provide a process for eliminating foul odor inherent in animal fibers and for preventing parasitism of insects as well as growth of mold.

It is a further object of the present invention to provide a process for extending the life of animal fibers.

These and other objects of the present invention together with the advantages thereof will become apparent to those skilled in the art from the detailed disclosure of the present invention as set forth hereinbelow.

BRIEF DESCRIPTION OF THE DRAWINGS

FIG. 1 is a schematic representation showing deodorization test by use of a negative ion generator.

FIG. 2 is a schematic representation in which a head space gas is taken out for the measurement by a gas-chromatography.

FIG. 3 and FIG. 4 are chromatograms for feathers subjected to the treatment by a negative ion generator and for non-treated feathers, respectively.

The present invention has been completed after a series of studies on the discovery that the foregoing drawbacks can be solved by charging fibers with negative ions, with a further result that parasitism of harmful insects and the like is prevented.

DETAILED DESCRIPTION OF THE INVENTION

The present invention encompasses a process for resuscitating animal fibers which comprises charging with negative ions animal fibers such as feather, wool, mohair, alpaca, cashmere, camel, vicugna and the like containing keratin as a main ingredient.

The charging of negative ions may be achieved using or not using an electroconductive board, through an electroconductive operation stand, internal walls of an equipment, pipe lines, conveyers and the like in at least one step selected from a package-opening steps, a defibering step, a carding step, a mixing step, a resin-coating step, a drying step, a stock step, a producing step of beddings, carpets and the like, a storage step of products or the like. The charging of negative ions may also be effected in an exclusive treating equipment.

When the treating equipment is used, the temperature is preferably between 20° C. and 35° C. and the humidity is preferably between 60% and 90%. Moreover, it is very effective to charge the animal fibers with negative ions while blowing off steam onto the animal fibers. Moreover, it is also effective to use water containing negative ions in a washing step. It is possible to effect concentrated charging of negative ions only to the side of the animal fibers by providing an insulating sheet at the backside of the electroconductive board.

The animal fibers are normally charged positive and therefore it is possible to remove dust more effectively by charging the dust positive to thus cause electric repulsion between the fibers and the dust in a dust-removal step. In this case, a dust-collecting effect is enhanced by charging a dust collector itself and/or air negative because of electric attracitve action of the collector and air.

Hereinafter, the present invention will be explained in more detail by away of experimental examples that follow, to which examples the invention is in no way limited.

EXPERIMENT 1

As was illustrated by FIG. 1, about 12 g of bedding feathers (1) were wrapped in a polyester net (2) and those were surrounded by a negative ion generator (3). Those were placed in a vinyl bag (4) and an inlet (5) was fastened to isolate the external atmosphere. Electric power was supplied to generate negative ions with which the feathers were charged for one month. As a negative ion generator, "ION ROLL (tradename, manufactured by RAKKASAN Co., Ltd.)" generators having an output of 1.5 W and 0.2 W were served.

For comparison, a similar experiment was carried out with the exception that the feathers were not subjected to the treatment by the negative ion generator.

After one month, as shown by FIG. 2, 5 g of treated and non-treated feathers were placed in 500-ml conical flasks (6), respectively, which were sealed with silicone rubber corks (8) having a hole (7) for samping, then the flasks (6) were placed in a thermostat and heated at 60° C. for 3 hours, then gas in a space of the flasks (head space gas) was subjected to the measurement by a gas-chromatography.

The obtained results were given in FIG. 3 (non-treated feathers) and FIG. 4 (feathers treated with an output of 1.5 W). In these figures, the outstanding two pearks are hydrogen sulfide ($H_2S$) and methyl mercaptan ($CH_3SH$) and the small peak adjacent thereto appears to be methyl sulfide ($CH_3SCH_3$).

As clear from the comparison of the two, an unexpectedly outstanding deodorization effect was admitted by subjecting feathers to the treatment by the negative ion generator. With the output of 0.2 W, the deodorization effect could hardly be obtained.

EXPERIMENT 2

As was shown by FIG. 2, 10 g of wool were placed in two conical flasks with humidity of about 90%. The one was sealed tightly with a silicone rubber cork and subjected to the treatment by the negative ion generator with an output of 1.5 W, while the other was isolated from the external atmosphere. The both flasks were left to stand for two months.

After the lapse of two months, the wool treated with negative ions are free of odor, whereas the wool non-treated emitted disagreeable odor inherent in protein. Gases in the flasks were subjected to the measurement by a gaschromatography, the main ingredients were hydrogen sulfide, methyl mercaptan and methyl sulfide.

EXPERIMENT 3

10 g of Wool were taken from a quilt which were being used actually and placed in two 100-ml neasuring cylinders to adjust the level to 50 ml. The humidity in the flasks was controlled to about 75% and isolated from the external atmosphere by seal with a polyethylene film. The one flask was treated with negative ions while the other was left to stand without such treatment.

The difference in volume between the two starts to be observed after 15 days. After three months, the level of negative ion-treated wool increased up to 64 ml, i.e., raising the volume by 30% approximately, whereas non-treated wool retained the original level.

As is apparent from foregoing, the present invention is capable of not only producing surprising deodorization effect, but retaining and reviving voluminous, fluffy and soft feel and touch inherent in the animal fibers. Still further, it was also ascertained that parasitism of harmful insects and growth of mold are effectively impeded by the charging of negative ions. The reasons why such marked effects can be provided are not made clear, but presumably the animal fibers are always held fresh by electric stimulation resulting from negative electric potential so that the fibers which lost crimps are not only recovered, but the fibers are kept from harmful insects. Accordingly, the present invention may also be applied to beddings during actual use. For instance, when the present invention is applied to quilts containing wool which are being actually used, release of foul odor and loss of crimps are prevented, while, in the case of quilts which lost crimps to be masses of fibers, emitting disagreeable odor, the fibers are resuscitated to result in possessing confortable soft touch, heatretaining property and lightweight.

What is claimed is:

1. A process for reducing animal fibers which comprises charging with only negative ions by the use of a negative ion generator of the type described in the specification animal fibers not in contact with said negative ion generator and being selected from the group consisting of feather, wool, mohair, alpaca, cashmere, camel and vicugna containing keratin as a main ingredient, said process being carried out a temperature between 20° C. and 35° C. and at a humidity of between 60% and 90%, with the output of the generator being sufficient to resuscitate said fibers under said conditions of temperature and humidity.

2. The process of claim 1, wherein the animal fibers are charged with negative ions in a package-opening step.

3. The process of claim 1, wherein the animal fibers are charge with negative ions while blowing steam onto the animal fibers.

4. The process of claim 1, wherein the animal fibers are charged with negative ions in a defibering step.

5. The process of claim 1, wherein the animal fibers are charged with negative ions in a carding step.

6. The process of claim 1, wherein the animal fibers are charged with negative ions in a mixing step.

7. The process of claim 1, wherein the animal fibers are charged with negative ions in a resin-coating step.

8. The process of claim 1, wherein the animal fibers are charged with negative ions in a drying step.

9. The process of claim 1, wherein the animal fibers are charged with negative ions in a stock step.

10. The process of claim 1, wherein the animal fibers are charged with negative ions in a producing of products step.

11. The process of claim 1, wherein the animal fibers are charged with negative ions in a product storage step.

12. The process of claim 1 wherein the output of the generator is 1.5 W or more.

* * * * *